US005127842A

United States Patent [19]

Kelly

[11] Patent Number: 5,127,842

[45] Date of Patent: Jul. 7, 1992

[54] ROTATING ELECTRICAL CONNECTOR

[76] Inventor: Steven M. Kelly, Box 139, Cromwell, Ind. 46732

[21] Appl. No.: 787,124

[22] Filed: Nov. 4, 1991

[51] Int. Cl.[5] ..... H01R 35/00

[52] U.S. Cl. ..... 439/165; 439/31; 29/857

[58] Field of Search ..... 439/31, 32, 119, 165, 439/209, 210, 211; 28/857

[56] References Cited

U.S. PATENT DOCUMENTS 4,241,965 12/1980 Wilson et al. ..... 439/31

4,825,540 5/1989 Kelly ..... 439/209 X

*Primary Examiner*—Eugene F. Desmond

*Attorney, Agent, or Firm*—Roger M. Rickert

[57] ABSTRACT

A modular electrical wiring system incorporates an improved rotating electrical connector which is designed to pass through a small decorator face opening. This opening may be in either or both of small cover or in an elongated raceway cover. The connector may then be twisted and pulled back flush with and filling the entire opening. The connector is attached to a semi-rigid conduit for supplying power to the modular electrical wiring system and may be installed or removed without the need for an electrician. The connector allows one-hundred and eight degrees of pivotal motion between itself and the semi-rigid conduit yet does not expose any of the conductors during such pivotal motion. The user may thus make minor adjustments in the location of attached equipment without the aid of an electrician nor the interruption of power.

17 Claims, 2 Drawing Sheets

ROTATING ELECTRICAL CONNECTOR

SUMMARY OF THE INVENTION

The present invention relates generally to electrical energy distribution systems of the type which may be configured by the user without the need for tools nor the services of a professional electrician and more especially to such power distribution systems of the modular type which are frequently incorporated into or used in conjunction with prefabricated and prewired office partitions and similar furniture. In particular, the present invention relates to an improved rotatable electrical connector for withdrawing or supplying electrical power through a standard decorator size receptacle opening which connector is adapted, in one position, to be passed through the opening without exposing any conductors.

The environment for the preferred embodiment of the lighting system relates to use in prefabricated office partitions with power and/or communication raceways running along the top and/or bottom edges. Prewired office partitions and similar modular furnishings with power and/or communications wiring running in raceways along the top or bottom of the partitions have been known for a number of years. The following U.S. Patents are exemplary, but by no means exhaustive of such modular electrical wiring arrangements. Prewired power systems for wall panels where power outlets or receptacles are positioned in predetermined fixed locations along a power raceway extending near the bottom of the panel, and jumper cables interconnect two or more such panels, again between predetermined locations along the raceways, are disclosed in U.S. Pat. No. 4,060,294. A variation on the previous patent which allows a measure of selectability of one of multiple circuits extending through the raceway is shown in the U.S. Pat. No. 4,367,370. An improvement which allows positioning of the power outlets or receptacles at virtually any location along the power distribution system are shown in my U.S. Pat. Nos. 4,688,869 and 4,825,540. U.S. Pat. No. 4,408,820 illustrates improvements in the terminals used to interconnect conduits while, at the same time allowing the connection of taps such as power receptacles to the wiring within the conduits. A number of other somewhat similar techniques for connecting receptacles to modular wiring systems are also known. Illustrative of such known power systems are U.S. Pat. Nos. 4,056,297 and 4,135,775.

One drawback of such modular wiring systems is the need for rather large, clumsy, ugly power-in connectors such as illustrated generally by reference numeral 11 in FIG. 1 of my abovementioned U.S. Pat. No. 4,688,869 patent, a portion of which is reproduced hereinafter as FIG. 4. With this arrangement, the sheath 47 (required by the National Electrical Code) is rigidly attached to the block 17 and presents a unsightly obstacle extending from, for example, the base of a modular furniture wall. Cast metal fittings have been made available which allow rigid connection with the power supply extending parallel, perpendicular or at a forty-five degree angle to the raceway, but these neither allow for any modification of the angle, nor are they capable of passing through a decorator face opening.

Modern offices, for example, have in recent years adopted rectangular faced duplex outlets, switches, etc. These devices and their required faceplate openings contrast to the twin oval openings and small rectangular toggle switch openings still common in residential use. These larger rectangular openings (commonly referred to a designer or decorator products) have become common and nearly a new standard in office and commercial construction.

Power entry connectors which are rotatable much like the hands of a clock have been used, but are prone to damage the conductors and are too large to pass through decorator openings. Back and forth pivotable connectors have also been used, but result in exposed conductors requiring both the services of a qualified electrician and the installation of a separate protective cap after rotation to the desired left or right orientation. Still others have attempted to utilize the decorator style face openings in conjunction with power supply cables, but such connectors have been too large to pass through the opening and again require a qualified electrician.

Until now, no single connector has been available which will both fit through such a decorator face opening as well as be adjustable by office users when rearranging furnishings relative to other furnishings or relative to wall, floor or ceiling power supplies.

Among the several objects of the present invention may be noted the provision of a plug which may be mated with a modular furniture wiring arrangement to supply power to that arrangement; the provision of a plug in accordance with the previous object which is neat in appearance and presents a minimal obstruction; and the provision of a connector adapted to both fit through a decorator face opening and be adjustable by office users when rearranging furnishings relative to other furnishings or relative to wall, floor or ceiling power supplies. These as well as numerous other objects and advantageous features of the present invention will be in part apparent and in part pointed out hereinafter.

In general, a modular electrical wiring system for upstanding wall panels of the type having one or more elongated raceways extending along an edge of a panel has a plurality of electrical conductors disposed within the raceways. A flexible conduit extends from the raceway and contains additional electrical conductors. There is an electrical connector for coupling the flexible conduit electrical conductors and the raceway electrical conductors as well as a decorative cover having a generally rectangular opening therein through which the connector may be passed preparatory to coupling the flexible conduit electrical conductors and the raceway electrical conductors.

Also in general and in one form of the invention, there is an electrical energy distribution system having at least one elongated relatively rigid power distribution raceway with connectors for receiving electrical energy from an energy source. An improved connector for coupling the energy source and the connectors includes a female connector block having a plurality of terminals for connecting to and supplying electrical energy to the connectors and a semi-rigid or flexible conduit containing a plurality of conductors connected to selected ones of the connector block terminals. The semi-rigid conduit and the connector block are pivotably coupled for relative pivotal motion therebetween while precluding user contact with the conductors. In one preferred form, the pivotable coupling allows relative motion between the semi-rigid conduit and the connector block through about 180 degrees and further includes a detent arrangement for retaining the semi-rigid conduit near each of the respective extremes of its pivotal travel.

Still further in general and in one form of the invention, a method of assembling a power-in cable to a modular wiring raceway of a type having a rectangularly apertured raceway cover includes providing an elongated flexible power cable with a pivotable connector at one end thereof. The connector is pivoted to one of its extreme positions so that the connector extends in the general direction of cable elongation and may be passed through the rectangular opening. The connector is then coupled to the raceway, and the cover positioned over the connector.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 4:
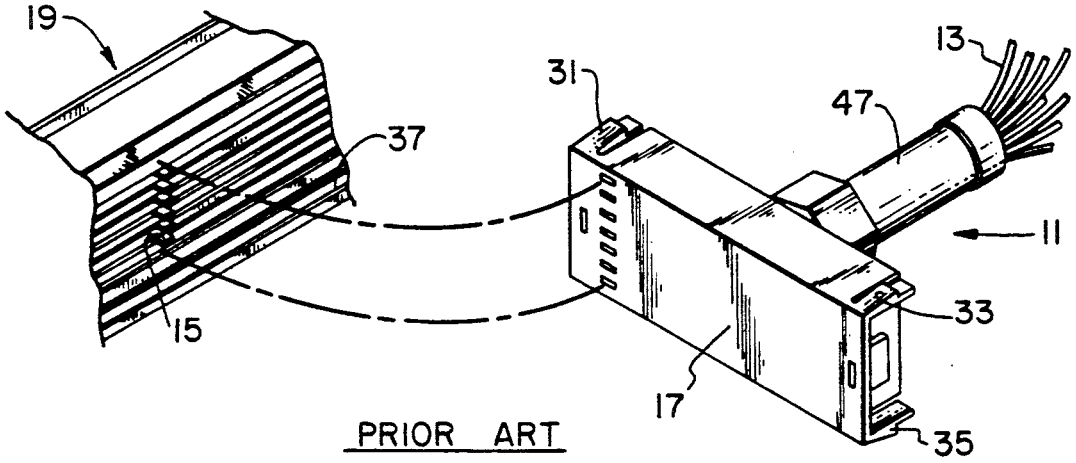
PRIOR ART FIG. 4
FIG. 4 is a perspective view of a prior art power in connector arrangement.

Referring briefly to FIG. 4, the flexible or semi-rigid conduit 11 brings initial power to a distribution system 19 of the type disclosed in my abovementioned patents with leads such as 13 being wired to a power source by a qualified electrician using conventional wiring techniques. Of course, other types of connectors not requiring the services of a qualified electrician might be used instead. All connections thereafter are a simple snap fit operation requiring no tools for assembly or disassembly. Power is supplied to a particular track or channel through a set of cantilevered blades 15 by mating the female connector block 17 thereto. Connector block 17 is held in position by detents such as 31, 33 and 35 engaging the undercuts or ledges 37 along the track edges. The system shown in FIG. 1 provides somewhat the same results, but in a vastly improved way.

Figure 1:
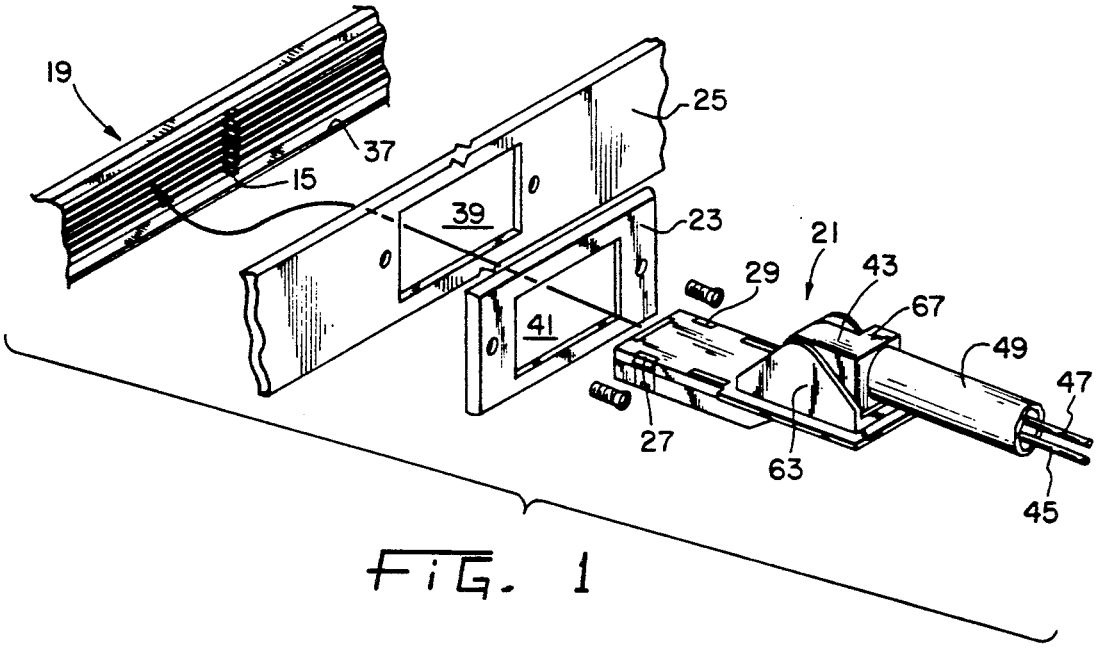
FIG. 1 is an exploded perspective view of a modular wiring track, decorative cover, rotatable connector and cover plate.

In FIG. 1, the power supply connector blades 15 are in contact with elongated conductor bars in and extend from power distribution channel or track 19. A raceway cover 25 is provided for covering the track as well as any communication or other wiring that may be located along the edge of a panel. Cover 25 includes a rectangular opening 37 through which the female connector block 21 may be passed. A decorative faceplate or cover 23 with a similar rectangular opening 41 may be provided if desired. The joint between the female connector block 21 and the conduit 49 lies within the turret 43. The semi-rigid multiconductor power supply cable 49 of FIG. 1 and 47 of FIG. 4 may be of the flexible metal conduit type, coated flexible metal conduit, PVC or other type protective sheath which meets safety code requirements.

Figure 2:
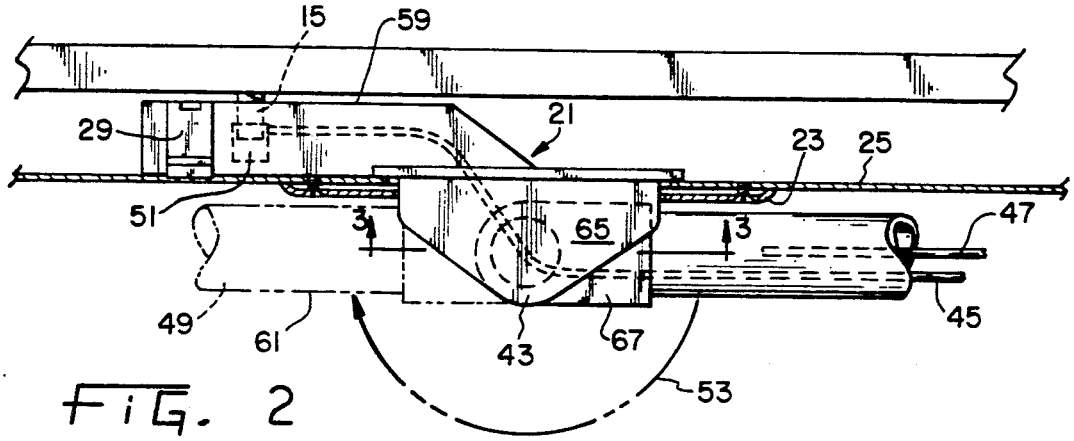
FIG. 2 is a top plan view of the components of FIG. 1 in their assembled positions.

The preferred environment of the modular electrical wiring system of the present invention is in upstanding wall panels as noted earlier. Typically, an elongated raceway extends along the an edge of such panels and a plurality of electrical conductors disposed within the raceway. For example, the power distribution channel 19 may be disposed in such a raceway. The flexible conduit 49 extends from the raceway as best seen in FIG. 2 and contains additional electrical conductors such as 45 and 47. The female connector block functions as an electrical connector for coupling the flexible conduit electrical conductors and the raceway electrical conductors and has plurality of terminals such as 51 of FIG. 2 for connecting to and supplying electrical energy to the raceway electrical conductor bars by way of the blades 15. The connector block 21 and flexible conduit 49 are pivotably coupled for relative pivotal motion therebetween while precluding user contact with the additional electrical conductors 45 and 47 with that coupling allowing relative motion between the flexible conduit and the connector block through about 180 degrees as indicated by the semicircular arrow 53 in FIG. 2.

Figure 3:
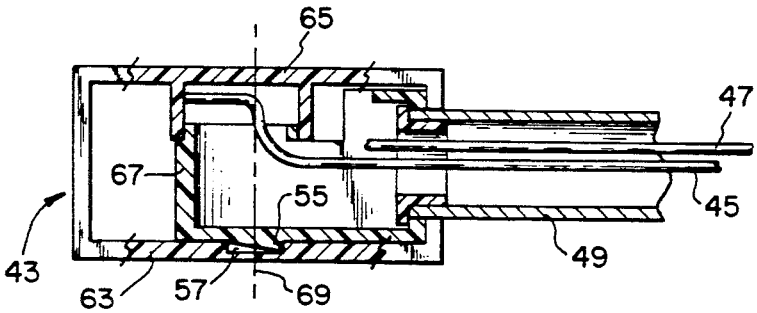
FIG. 3 is a view in cross-section along lines 3—3 of FIG. 2.

The pivotable coupling arrangement includes a dome-like turret 43 upstanding from the connector block 21 whereby the flexible conduit 49 may be pivoted from one extreme position closely adjacent the connector block through about 180 degrees to another position again closely adjacent the connector block as shown by the solid and dotted positions of conduit 49 in FIG. 2. In FIG. 2, the flexible conduit 49 extends in a generally horizontal direction parallel to the elongated raceway 19 in either of its positions closely adjacent the connector block 21. Returning to FIG. 1, it will be noted that the connector block 21 may be passed through the opening 41 in decorative cover 23 (or opening 39 in cover 25) only when the flexible conduit 49 is in the selected one of the two positions closely adjacent the connector block, namely the position shown in FIG. 1 and in solid lines in FIG. 2. When in the position shown in dotted lines in FIG. 2, the distance between surfaces 59 and 61 is too great to pass through the smaller dimension of the rectangular openings. The dome-like turret is of generally rectangular cross-section with fixed opposed parallel surfaces 63 and 64 separated by a distance which fits snugly within the lesser dimension of the rectangular opening in the decorative cover. The inner portion 67 of turret 43 pivots 180 degrees about axis 69. An interlockable ledge 55 notch 57 shown in FIG. 3 provides a detent function for retaining the flexible conduit near each of the respective extremes of its pivotal travel.

The method of connecting the power-in cable to a modular wiring raceway of a type having a rectangularly apertured cover should now be clear. A flexible power cable with a pivotable connector at one end thereof is provided. The connector is pivoted to one of its extreme positions so that the connector extends forwardly in the general direction of cable elongation. In this configuration, the connector may be passed through the rectangular opening. Once through, the connector is coupled to the raceway and the cover nestled into position thereover. All of this may be accomplished without the need for the services of a qualified electrician.

From the foregoing, it is now apparent that a novel pivotable power connector feature for modular or similar wiring systems has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A modular electrical wiring system for upstanding wall panels comprising an elongated raceway adapted to extend along an edge of a panel, a plurality of electrical conductors disposed within the raceway, a flexible conduit extending from the raceway and containing additional electrical conductors, an electrical connector for coupling the flexible conduit electrical conductors and the raceway electrical conductors, and a decorative cover having a generally rectangular opening therein through which the connector may be passed preparatory to coupling the flexible conduit electrical conductors and the raceway electrical conductors.

2. The modular electrical wiring system of claim 1 wherein the electrical connector comprises a female connector block having a plurality of terminals for connecting to and supplying electrical energy to the raceway electrical conductors.

3. The modular electrical wiring system of claim 2 further comprising means pivotably coupling the flexible conduit and the connector block for relative pivotal motion therebetween while precluding user contact with the additional electrical conductors.

4. The modular electrical wiring system of claim 1 wherein the pivotable coupling allows relative motion between the flexible conduit and the connector block through about 180 degrees.

5. The modular electrical wiring system of claim 4 wherein the means pivotably coupling further includes detent means for retaining the flexible conduit near each of the respective extremes of its pivotal travel.

6. The modular electrical wiring system of claim 3 wherein the means pivotably coupling comprises a dome-like turret upstanding from the connector block whereby the flexible conduit may be pivoted from one extreme position closely adjacent the connector block through about 180 degrees to another position again closely adjacent the connector block.

7. The modular electrical wiring system of claim 6 wherein the dome-like turret is of generally rectangular cross-section and adapted to fit snugly within the rectangular opening in the decorative cover.

8. The modular electrical wiring system of claim 7 wherein the connector block may be passed through the decorative cover only when the flexible conduit is in a selected one of the two positions closely adjacent the connector block.

9. The modular electrical wiring system of claim 6 wherein the flexible conduit extends in a generally horizontal direction parallel to the elongated raceway in either of its positions closely adjacent the connector block.

10. In an electrical energy distribution system having at least one elongated relatively rigid power distribution raceway having connector means for receiving electrical energy from an energy source, an improved connector for coupling the energy source and the connector means comprising:

a female connector block having a plurality of terminals for connecting to and supplying electrical energy to the connector means;

a semi-rigid conduit containing a plurality of conductors connected to selected ones of the connector block terminals; and means pivotably coupling the semi-rigid conduit and the connector block for relative pivotal motion therebetween while precluding user contact with the conductors.

11. The improved connector of claim 10 wherein the pivotable coupling allows relative motion between the semi-rigid conduit and the connector block through about 180 degrees.

12. The improved connector of claim 11 wherein the means pivotably coupling further includes detent means for retaining the semi-rigid conduit near each of the respective extremes of its pivotal travel.

13. The improved connector of claim 10 wherein the means pivotably coupling comprises a dome-like turret upstanding from the connector block whereby the semi-rigid conduit may be pivoted from one extreme position closely adjacent the connector block through about 180 degrees to another position again closely adjacent the connector block.

14. The improved connector of claim 13 wherein the electrical energy distribution system further includes at least one decorative cover having a generally rectangular opening therein through which the connector block may be passed preparatory to connection to the connector means, the dome-like turret being of generally rectangular cross-section and adapted to fit snugly within the rectangular opening in the decorative cover.

15. The improved connector of claim 14 wherein the connector block may be pased through the decorative cover only when the semi-rigid conduit is in a selected one of the two positions closely adjacent the connector block.

16. The improved connector of claim 13 wherein the semi-rigid conduit extends in a generally horizontal direction parallel to the rigid power distribution raceway in either of its positions closely adjacent the connector block.

17. The method of assembling a power-in cable to a modular wiring raceway of a type having a rectangularly apertured raceway cover comprising the steps of providing an elongated flexible power cable with a pivotable connector at one end thereof, pivoting the connector to one of its extreme positions so that the connector extends in the general direction of cable elongation, passing the connector through the rectangular opening, coupling the connector to the raceway, and positioning the cover over the connector.

* * * * *